US005852251A

United States Patent [19]

Su et al.

[11] Patent Number: 5,852,251

[45] Date of Patent: Dec. 22, 1998

[54] METHOD AND APPARATUS FOR REAL-TIME DYNAMIC MIDI CONTROL

[75] Inventors: Alvin Wen-Yu Su, Hwa-Tang Hsiang; Ching-Min Chang, Hsinchu; Liang-Chen Chien, Meisan Hsiang; Der-Jang Yu, Changhua, all of Taiwan

[73] Assignee: Industrial Technology Research Institute, Taiwan

[21] Appl. No.: 882,236

[22] Filed: Jun. 25, 1997

[51] Int. Cl.[6] ..... G10H 7/00

[52] U.S. Cl. ..... 84/645

[58] Field of Search ..... 84/622–625, 645

[56] References Cited

U.S. PATENT DOCUMENTS

| | | | |
|---|---|---|---|
| 5,119,711 | 6/1992 | Bell et al. | 84/645 X |
| 5,140,887 | 8/1992 | Chapman . | |
| 5,208,421 | 5/1993 | Lisle et al. | 84/645 |
| 5,376,752 | 12/1994 | Limberis et al. | 84/645 X |
| 5,453,570 | 9/1995 | Umeda et al. | 84/645 X |
| 5,471,008 | 11/1995 | Fujita et al. . | |
| 5,521,323 | 5/1996 | Paulson et al. . | |
| 5,521,324 | 5/1996 | Dannenberg et al. . | |
| 5,574,243 | 11/1996 | Nakai et al. . | |
| 5,596,159 | 1/1997 | O'Connell | 84/645 X |
| 5,616,878 | 4/1997 | Lee et al. . | |

*Primary Examiner*—Stanley J. Witkowski
*Attorney, Agent, or Firm*—Finnegan, Henderson, Farabow, Garrett & Dunner, L.L.P.

[57] ABSTRACT

A real time dynamic MIDI controller pre-processes MIDI files to facilitate playback by re-formatting stored MIDI files into a modified MIDI file format and simultaneously eliminating MIDI META events that are stored in the file, but unnecessary for playback. The MIDI controller includes an administrator to effect channel grouping, channel voice message grouping, or a combination thereof, to facilitate the control of selected MIDI file parameters. The real time dynamic MIDI controller also includes an output interface circuit to coordinate the transmission of one or more MIDI file that the MIDI controller has processed.

16 Claims, 9 Drawing Sheets

METHOD AND APPARATUS FOR REAL-TIME DYNAMIC MIDI CONTROL

BACKGROUND OF THE INVENTION

1. Field of the Invention

This invention relates generally to a musical instrument digital interface (hereinafter "MIDI") and, more particularly, to a MIDI controller that has the capacity to change MIDI parameters in real-time.

2. Description of the Related Art

Musical instruments generate acoustic waves to produce music. For example, FIG. 1 shows a piano 100. Piano 100 has a plurality of keys 102. Each key 102 is coupled to a hammer 104, of which only one key/hammer combination is shown. Piano 100 also includes a plurality of tensioned wires 106, one of wires 106 being associated with hammer 104. Operationally, a musician presses one or more of keys 102. Key 102 moves the associated hammer 104 to strike the associated one of wires 106. The vibration of wire 106 generates the acoustic wave. The actual tone produced by the vibration of wire 106 depends on the length of wire 106, the tension the wire is subject to, and the energy the musician imparts to wire 106 through the striking of key 102.

It is possible to electronically produce the vibration of wire 106 and generate music using electronic synthesizers. FIG. 2 shows an electronic keyboard 200 with a plurality of keys 202. The musician plays electronic keyboard 200 by striking any key 202 in a manner similar to piano 100. When one of keys 202 is depressed, instead of causing a hammer to strike a wire, keyboard 200 generates an electronic music signal 204. Music signal 204 is received by a tone generator 206. Tone generator 206 uses music signal 204 to produce the acoustic wave. FIG. 2 shows how some electronic synthesizers, for example keyboard 200, contain both keys 202, which determine what acoustic wave the musician wants to generate (i.e., the controller portion), and tone generator 206, which actually generates the acoustic wave (i.e., the sound generator).

FIG. 3. shows that it is possible to separate the controller portion and the sound generator into separate parts. With reference to FIG. 3, an electronic keyboard 300 includes a plurality of keys 302. When one of keys 302 is depressed, keyboard 300 generates an electronic music signal 304. Keyboard 300 is electrically connected to a tone generator 306, which is physically separate from keyboard 300, by a physical connector 308.

Keyboards 200 or 300 and their associated tone generators 206 or 306, respectively, can communicate using one of several industry standard musical interfaces. These interfaces can be digital. One digital interface known in the industry is MIDI. For example, in the case of keyboard 200, using the MIDI interface, when a musician plays a musical score on keyboard 200 by striking one or more keys 202, keyboard 200 produces a digital MIDI signal. The associated tone generator uses the MIDI file or MIDI signal to produce the desired music. For additional information regarding MIDI see Christian Braut, *The Musician's Guide to MIDI,* Sybex, 1994 or Rob Young, *The MIDI Files,* Prentice Hall, 1996. A MIDI file stored in format 0 contains both MIDI META events ("MME") and MIDI voice message events ("MVE"). One sequential string of events is also known as chunk data. MMEs represent data in the MIDI file comprising the copyright information, the notice text, sequence/track name text, set tempo information, etc. MVEs represent data in the MIDI file comprising channel information, note on/off information, note pitch and timbre information, etc. Each event (MME or MVE) is stored with a delta time component. Each unit of delta-time equals (Tempo time)/(the number of clock ticks per MIDI-quarter-note). Tempo time is defined by the set tempo MME. Thus, the delta time component is microseconds per number of clock ticks. Each delta time unit represents a time delay between stored events. The accumulation of delta time units in chunk data from the first event stored in the chunk data to another event in the chunk data represents the total elapsed time from the beginning of the musical score until that event is played.

Each MIDI file can be stored in one of three formats. Format 0 files contain MVEs in the sequence that the musician played the corresponding musical notes/cords. In other words, format 0 files contain MVEs in the sequence they are to be played. The information stored in formats 1 and 2 files is similar to format 0; however, unlike format 0, MIDI files stored in formats 1 and 2 contain multiple sequential strings of events or multiple chunk data. Also, format 1 files only contain MMEs in the first chunk data, and format 2 files contain most MMEs in the first chunk data (each format 2 chunk data, for example, has a set tempo). MVEs, however, are stored in each chunk data. Thus, format 1 and 2 files do not contain the MVEs in a single sequence as played by a musician. Instead, they contain the information for each of multiple tracks in the sequence played by the musician. A track is a label of the music associated with that chunk data. For example, percussion may be stored to one track, strings to a second track, and woodwinds to a third track. The total number of chunk data that make up a format 1 or 2 MIDI file corresponds to the number of tracks.

Most of the MMEs in a MIDI file are not needed by the tone generator to produce the electronic music signal. Additionally, because format 1 and 2 are not stored sequentially, but rather sequentially by track, the files require significant processing resources to make real time adjustments to the MIDI files during playback. Therefore, it would be desirable to reduce the processing time and resources required for real time adjustments during playback of MIDI files.

SUMMARY OF THE INVENTION

The advantages and purpose of this invention will be set forth in part from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, systems consistent with the present invention reduce the processing time and resources required for real time processing of musical instrument digital interface (MIDI) files by re-formatting the MIDI files into a modified format and eliminating MIDI events not necessary for the playback. To accomplish this a pre-processor extracts timing information and stores the timing information in a modified MIDI file. Then the pre-processor sequentially extracts each MIDI event to determine whether the event is either a MIDI voice message event or a MIDI META set tempo event. If it is determined that the event is either a MIDI voice message event or a MIDI META set tempo event, the event is also stored in the modified MIDI file, otherwise it is discarded.

Moreover, systems consistent with the present invention reduce the processing time and resources required for real time processing of musical instrument digital interface (MIDI) files by grouping various MIDI channels, MIDI channel voice messages, or any combination thereof. Group control facilitates the supplying of a real-time control signal to MIDI channels during the playback of the MIDI file.

BRIEF DESCRIPTION OF THE DRAWINGS

The accompanying drawings, which are incorporated in and constitute a part of this specification, illustrate preferred embodiments of the invention and, together with the description, explain the goals, advantages and principles of the invention. In the drawings.

DESCRIPTION OF THE PREFERRED EMBODIMENT

Reference will now be made in detail to the present preferred embodiments of the invention, examples of which are illustrated in the accompanying drawings. It is intended that all matter contained in the description below or shown in the accompanying drawings shall be interpreted as illustrative and not in a limiting sense.

Methods and apparatus in accordance with this invention are capable of responsive and dynamic real time control of MIDI files during playback. The responsive and dynamic real-time control is achieved primarily by providing a MIDI controller that pre-processes each MIDI file. Additionally, the MIDI controller is constructed to enable a user to group similar MIDI instruments such that the MIDI controller changes user selected MIDI parameters for the user-defined group substantially simultaneously.

Figure 1:
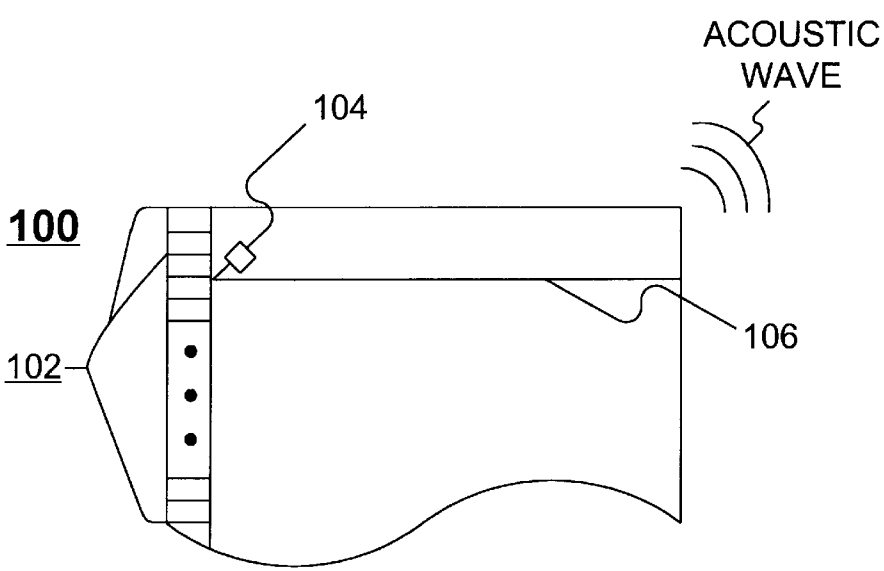
FIG. 1 is a diagrammatic representation of a conventional piano.
Figure 2:
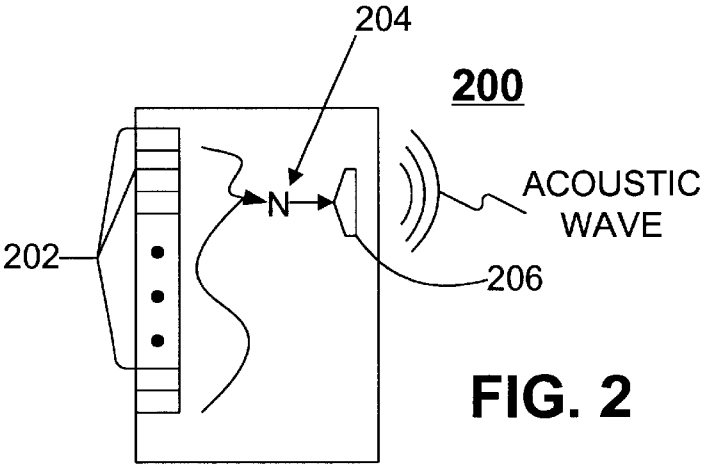
FIG. 2 is a diagrammatic representation of a conventional electronic keyboard.
Figure 3:
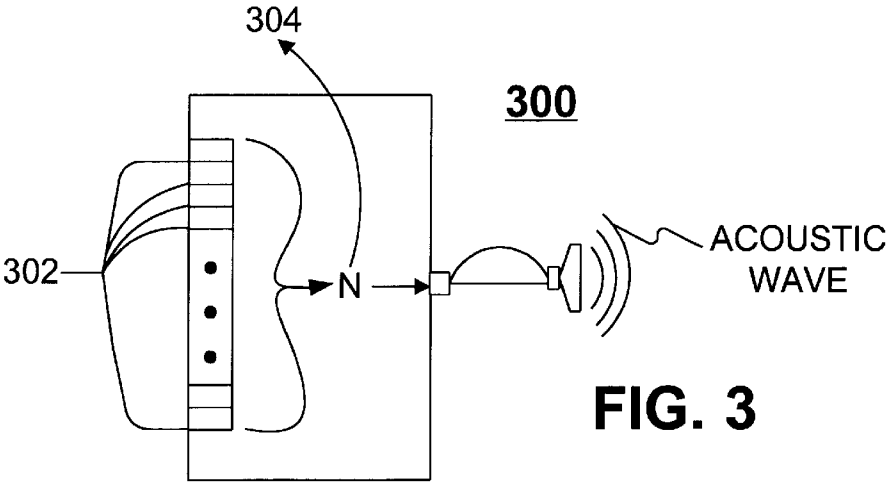
FIG. 3 is a diagrammatic representation of another conventional electronic keyboard.
Figure 4:
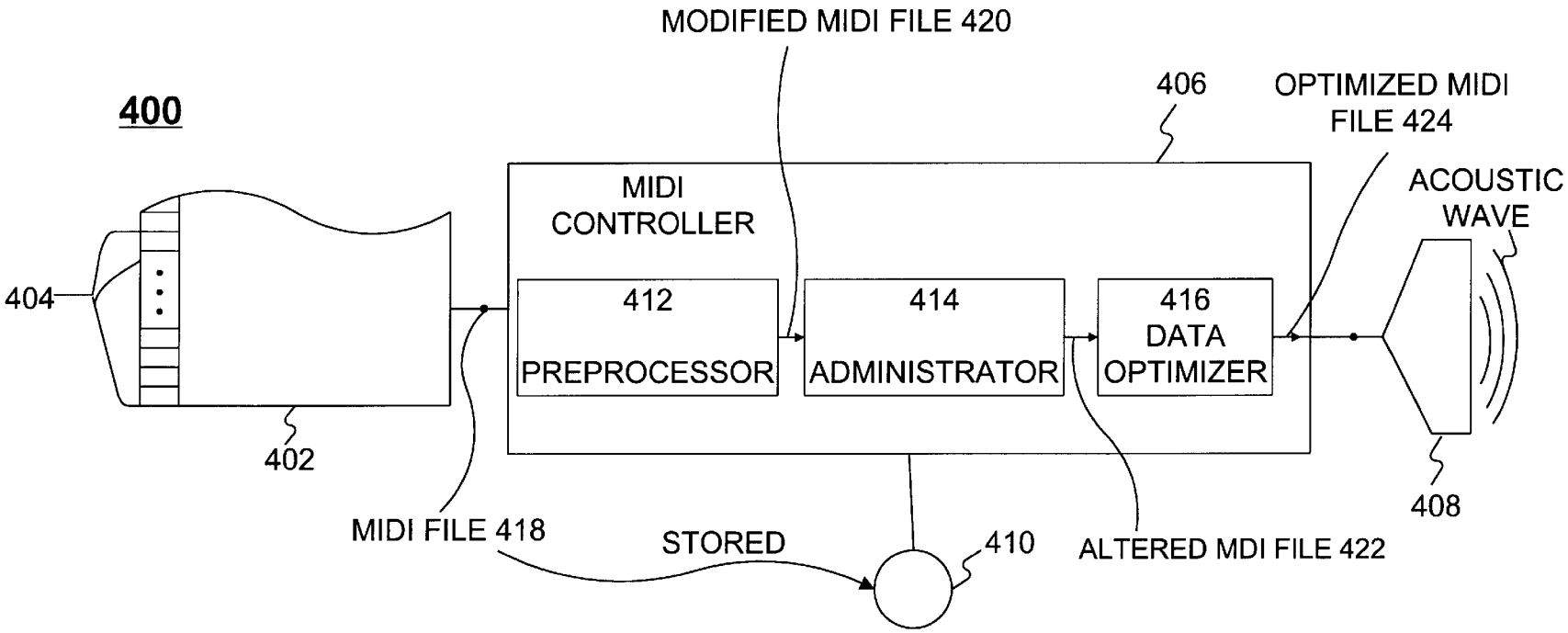
FIG. 4 is a diagrammatic representation of a recording system constructed in accordance with the present invention.

FIG. 4 represents a recording system 400 constructed in accordance with the present invention. Recording system 400 includes a keyboard 402 that has a plurality of keys 404, a MIDI controller 406, a tone generator 408, and a memory 410. MIDI controller 406 can be a personal computer or other alternative, such as, for example, a mixing board adapted to include the features described herein. MIDI controller 406 includes a pre-processor 412, a control process administrator 414, and a data optimizer 416. Pre-processor 412 modifies a MIDI file 418, which is stored in memory 410, to produce a modified MIDI file 420. Administrator 414 alters modified MIDI file 420 to produce an altered MIDI file 422 in real-time. Data optimizer 416 optimizes altered MIDI file 422 and produces an optimized MIDI file 424 for transmission to tone generator 408.

The user (musician) operates recording system 400 by pressing keys 404 of keyboard 402. Keyboard 402 generates a bit-stream that can be stored as a MIDI file 418, which can be of any format, representative of a musical score, that is received by MIDI controller 406. When generated by keyboard 402, MIDI controller 406 acts as a conduit to either store MIDI file 418 in a memory 410 or passes the MIDI bit-stream to tone generator 408. MIDI controller 406 allows a musician to adjust the MIDI parameters of the music when the stored MIDI file 418 is played. Alternatively, Keyboard 402 can generate the MIDI bit-stream to be stored in memory 410 as MIDI file 418 prior to connection of MIDI controller 406. When connected in this manner, keyboard 402 can be connected directly to tone generator 408 and/or memory 410.

MIDI controller 406, however, is preferably used when recording system 400 plays the musical score by retrieving MIDI file 418 directly from memory 410. To play the musical score, MIDI controller 406 retrieves MIDI file 418 from memory 410, processes it through pre-processor 412, administrator 414, and data optimizer 416, and sends the optimized MIDI file to tone generator 408. MIDI controller 406 is equipped with pre-processing and various control processes, described in more detail below, that allow real time adjustment of the MIDI file to enhance the quality of the playback.

In one preferred embodiment, pre-processor 412, administrator 414, and data optimizer 416 of MIDI controller 406 are respectively implemented in software executed by a microprocessor of a host personal computer. In another embodiment, MIDI controller 406 is constructed to include a dedicated microprocessor for executing software corresponding to the respective functions of pre-processor 412, administrator 414, and data optimizer 416. In still a further embodiment, the functions of the respective components of MIDI controller 406 are implemented in circuit hardware or a combination of hardware and software.

In the description that follows, the functions of each of pre-processor 412, administrator 414, and data optimizer 416 are set forth in detail to enable implementation of MIDI controller 406 in accordance with any of the above described embodiments thereof. Preferably, this system is installed on a personal computer using a windows based operating environment.

The pre-processing and control processing performed by MIDI controller 406 modifies MIDI parameters in real time to change MIDI file 418 such that the electronic music signal produced by tone generator 408 sounds more or less natural, in accordance with the desires of the user. In order to facilitate the ability of MIDI controller 406 to modify MIDI file 418 by control processing, MIDI controller 406 is equipped with pre-processor 412. Pre-processor 412 functions to convert the different format MIDI files from their existing formats into a standard format 0 type file. In addition, pre-processor 412 removes from each MIDI file information that is not necessary during playback, with the result that the MIDI files are converted into modified format 0 MIDI files. As described above, most MMEs stored in MIDI file 418 are not necessary during playback. This includes such MMEs as the copyright, the notice text, sequence/track name text, lyric text, the time signature, the key signature, etc. In fact, the only relevant information stored in the MIDI file 418 for the purpose of playback includes the set tempo MME, the third word of the chunk data (number of clock ticks per MIDI quarter note (hereinafter "NTK")), and MVEs.

Figure 5:
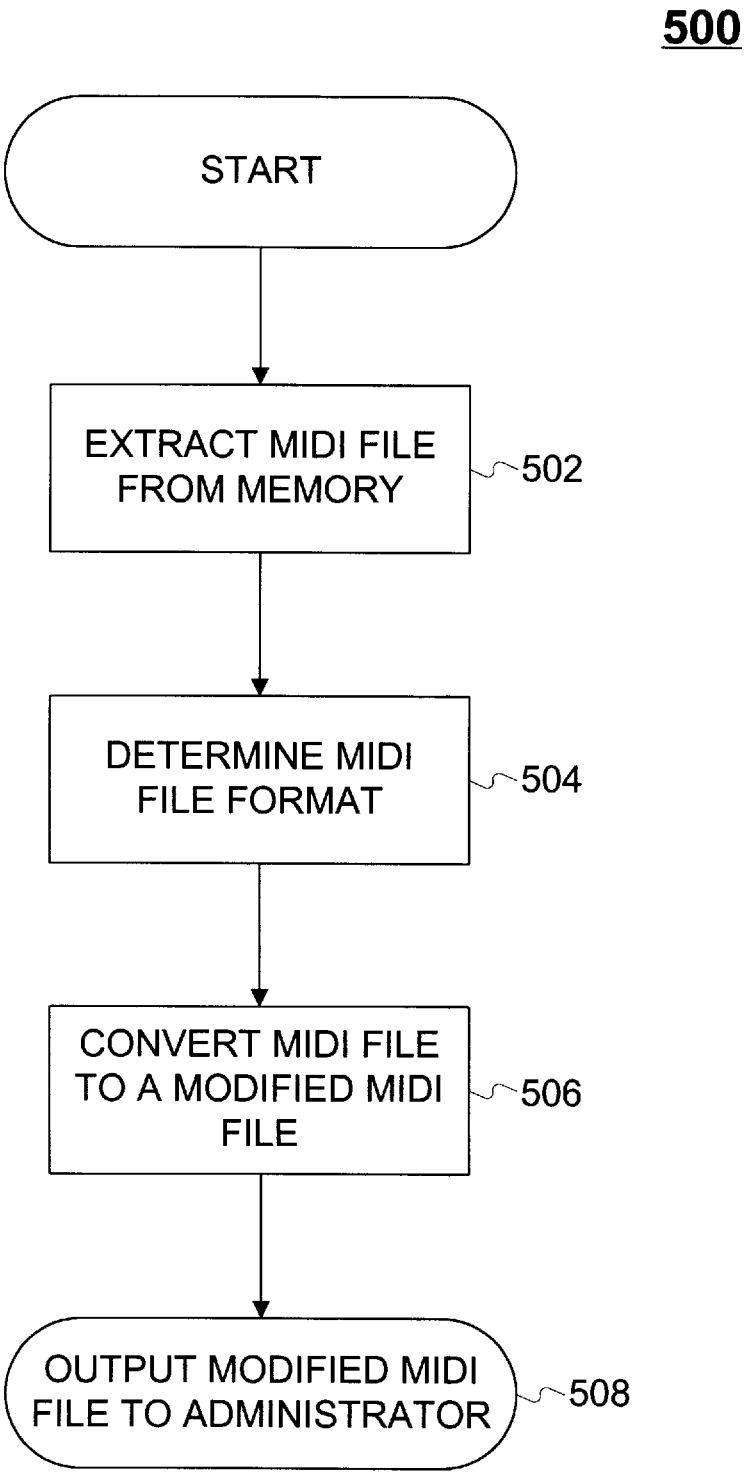
FIG. 5 is a flow chart illustrative of a method of pre-processing MIDI files in accordance with the present invention.

FIG. 5 is a flow chart 500 illustrating pre-processing functions performed by pre-processor 412. First, pre-processor 412 extracts MIDI file 418 stored in memory 410 (step 502). After extracting MIDI file 418, pre-processor 412 determines the format of MIDI file 418 (step 504). MIDI files can be stored in formats 0, 1, or 2. Depending on what file format pre-processor 412 detects, it converts that format into a modified format 0 MIDI file (step 506). The modified MIDI file is then output to administrator 414 (step 508).

Figure 6:
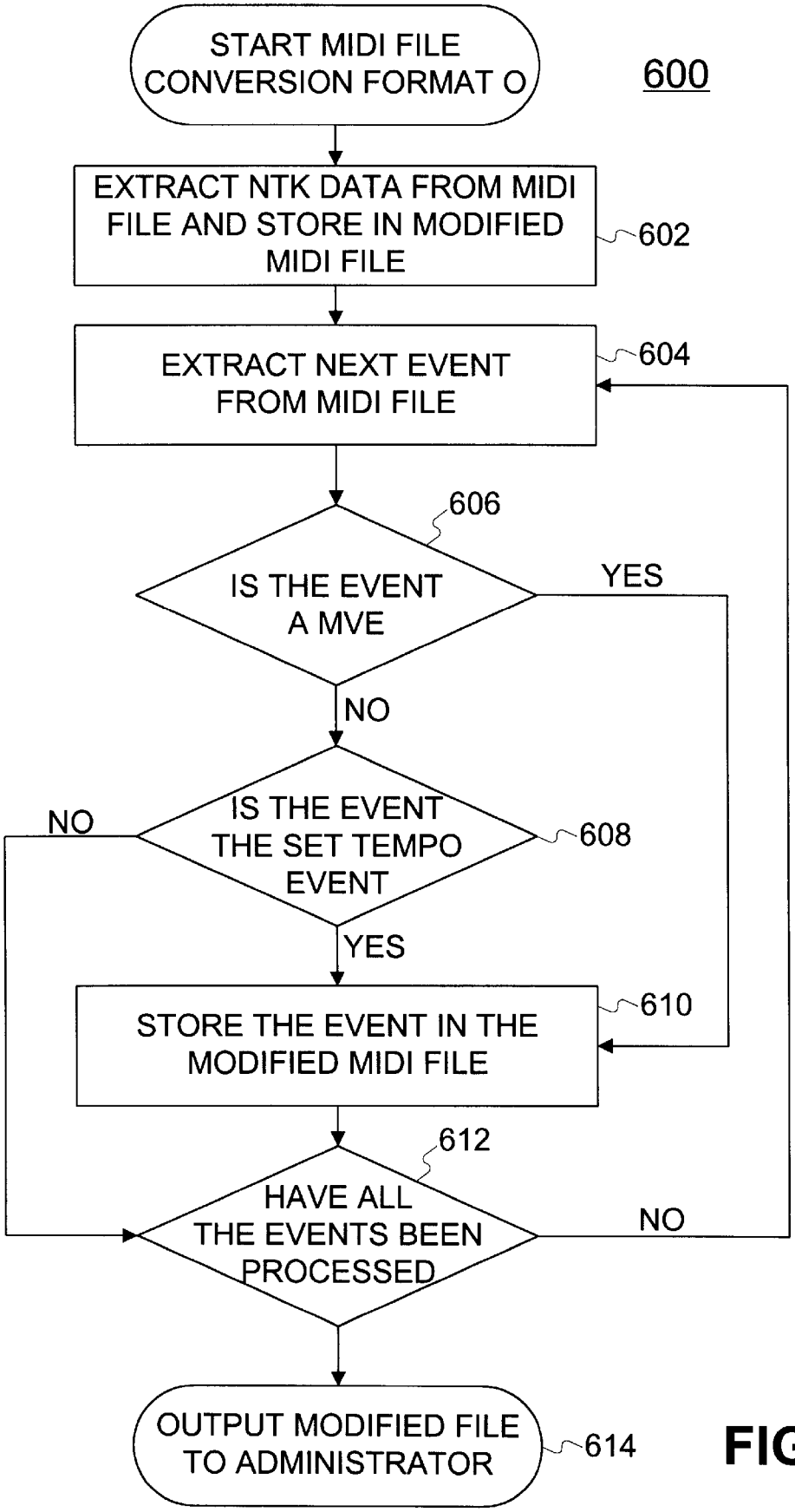
FIG. 6 is a flow chart illustrative of a method for converting format 0 MIDI files into modified format 0 MIDI files in accordance with the present invention.

FIG. 6 is a flow chart 600 illustrating the functions performed by pre-processor 412 to convert each MIDI file stored in format 0 into a modified format 0 MIDI file. For the purpose of the explanation of FIG. 6, it is assumed that MIDI file 418 is in format 0. First, pre-processor 412 extracts NTK from MIDI file 418 and stores NTK in modified MIDI file 420 (step 602). Pre-processor 412 then extracts the next MIDI event from MIDI file 418 (step 604). Pre-processor 412 determines whether the MIDI event is a MVE (step 606). If the MIDI event is a MVE, then the event is stored in modified MIDI file 420 (step 610). If the MIDI event is not a MVE and is instead a MME, then pre-processor 412 further determines whether the MME is the set tempo event (step 608). If the MME is the set tempo event, then it is stored in modified MIDI file 420 (step 610). Each file stored in the modified MIDI file contains delta time information and the MIDI events, which could be MVEs or the set tempo MME. Finally, pre-processor 412 determines whether all the MIDI events in MIDI file 418 have been processed (step 612). If all of the MIDI events have not been processed, then steps 604 through 612 are repeated, otherwise, the pre-processing is completed and modified MIDI file 420 is output to administrator 414 (step 614).

Figure 7:
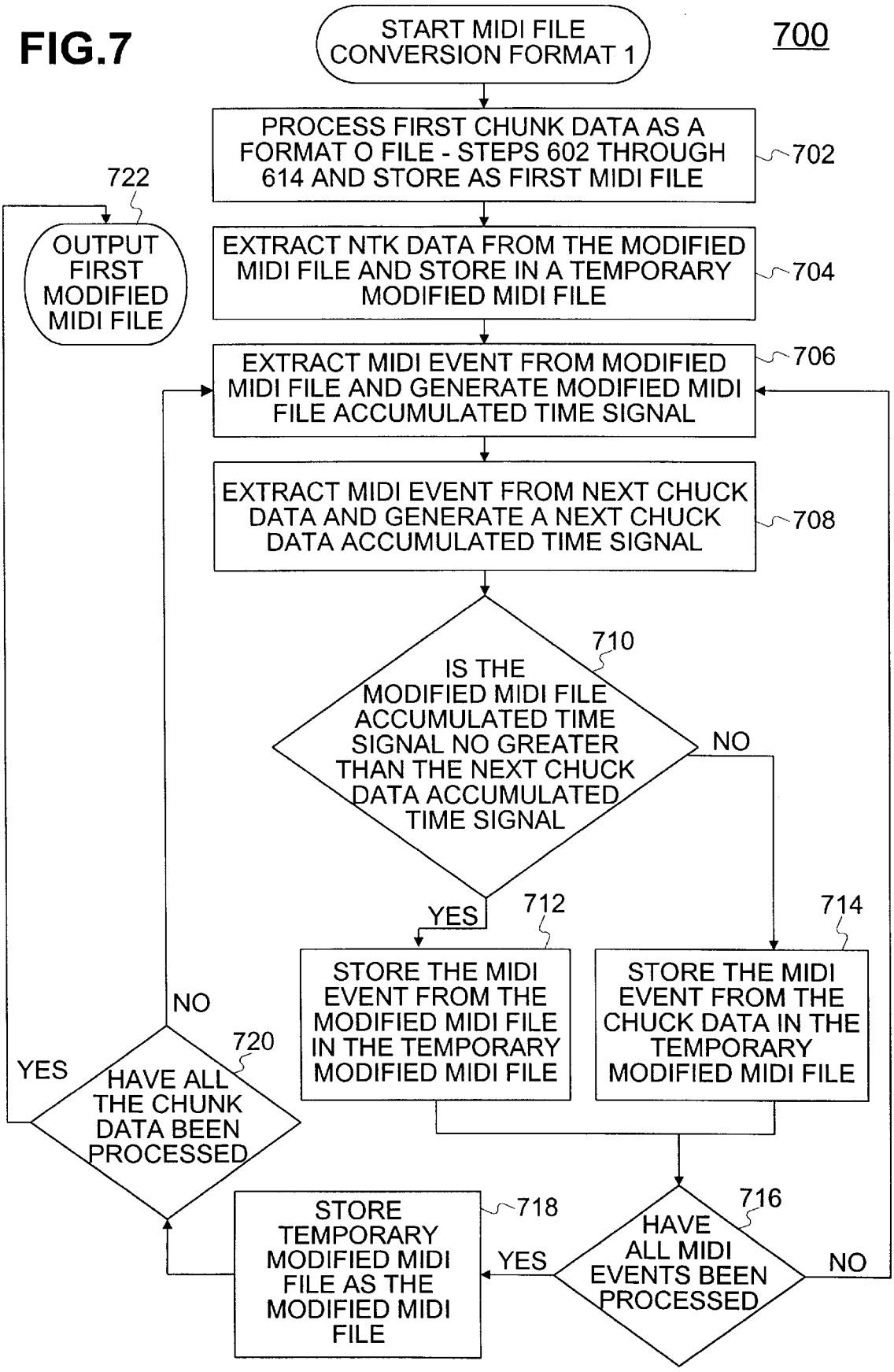
FIG. 7 is a flow chart illustrative of a method for converting format 1 MIDI files into modified format 0 MIDI files in accordance with the present invention.

FIG. 7 is a flow chart 700 illustrating the functions performed by pre-processor 412 to convert each MIDI file stored in format 1 into a modified format 0 MIDI file. As described above, format 1 files differ from format 0 files in that the MVE information is spread over multiple tracks in which a chunk data represents each of the tracks. The set tempo MME and NTK, however, are stored in the first chunk. Thus, the first chunk data is processed in the same manner as the format 0 file is processed in steps 602 through 614 described above, except that instead of outputting the modified MIDI file, it is stored as a modified MIDI file (step 702). Pre-processor 412 extracts the NTK data from the modified MIDI file and stores it to a temporary modified MIDI file (step 704). For format 1 MIDI files, the next chunk data examined, and each subsequent chunk data files, contains only MVEs. Thus, to create a single modified MIDI file stored in the format 0 protocol, pre-processor 412 merges the next chunk data and the modified MIDI file to obtain modified MIDI file 420. In order to ensure the MVEs are stored in the proper sequence, pre-processor 412 sequentially extracts the MVEs from the modified MIDI file and generates a modified MIDI file accumulated time signal (step 706). Substantially simultaneously, pre-processor 412 sequentially extracts events from the next chunk data and generates a next chunk data accumulated time signal (step 708). Next, pre-processor 412 determines whether the modified MIDI file accumulated time signal is no greater than the next chunk data accumulated time signal (step 710). If the modified MIDI file accumulated time signal is no greater than the next chunk data accumulated time signal, then the MVE from the modified MIDI file is stored in the temporary modified MIDI file and the next chunk data MVE is replaced in the chunk data (step 712). Otherwise, the next chunk data MVE is stored in the temporary modified MIDI file and the MVE from the modified MIDI file is replaced in the modified MIDI file (step 714). Pre-processor 412 repeats steps 706 through 714 until all the MVEs stored in both the modified MIDI file and the next chunk data are merged into the temporary modified MIDI file (step 716). Pre-processor 412 stores the temporary modified MIDI file as the modified MIDI file (step 718). Pre-processor 412 repeats step 706 through 718 until all chunk data files are processed (step 720). When all of the files are processed, modified MIDI file 420 is outputted to administrator 414 (step 722).

To convert MIDI files stored in the format 2 protocol, the process is the same as for converting format 1 files, with one difference. The difference is that in format 2 MIDI files, each chunk data has an independent set tempo and NTK event associated with it. This is different from both format 0 and format 1 files. Specifically, format 0 events are stored sequentially and no merging of chunk data is required. Format 1 events are each stored sequentially within each chunk, and each chunk has a consistent delta time value, which is stored in the first chunk, to allow pre-processor 412 to merger the events sequentially. Format 2 files are similar to format 1 files, however, the delta time value is not consistent for each chunk data. To merge the files, pre-processor 412 superimposes an artificial delta time to facilitate the merging of the chunk data into one file. In the preferred embodiment, a set tempo is set equal to 500,000 microseconds and NTK is set at 25,000. These values are selected to minimize the time error between the converted and original files. Instead of simply summing the delta time, as for format 1 MIDI files, for format 2 MIDI files the accumulated time for an event i ($T_s(i)$) equals the sum for n=0 to i of (delta time (n)•$T_p(n)$), where delta time (n) is the delta time numerical value of the $(n)^{th}$ event, and $T_p(n)$ is the set tempo value for the chunk at the time of the $(n)^{th}$ event. Thus, a new delta time value dt(i) for the $i^{th}$ event can be represented as dt(i) equals the rounded value of $[(T_s(i)-T_s(i-1))/T]$, where $T_s(-1)=0$, and T is (set tempo)/(NTK) (T=20 microseconds in this embodiment).

Figure 8:
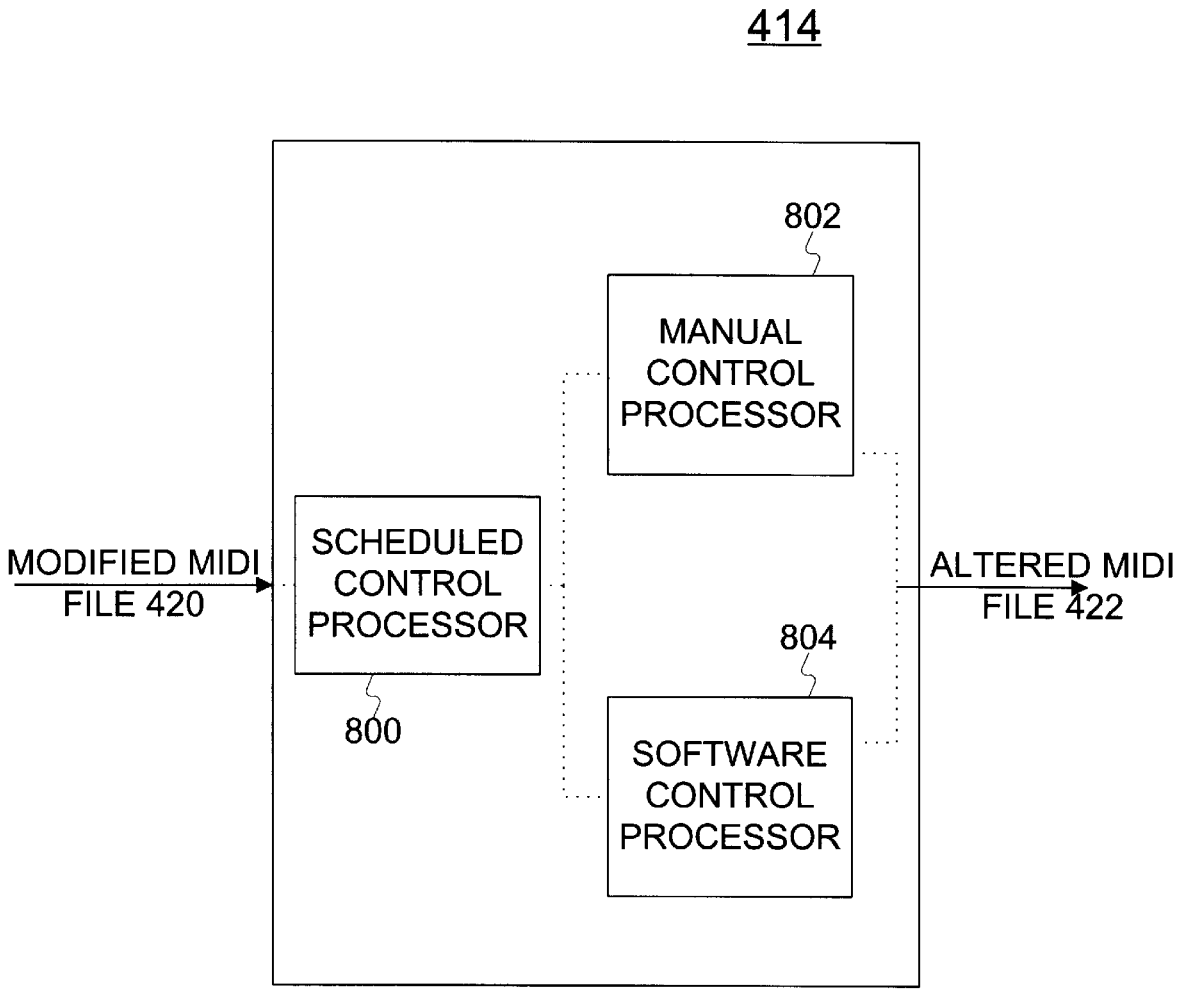
FIG. 8 is a diagrammatic representation of a control process administrator in accordance with the present invention.

After conversion by pre-processor 412 to a modified format 0 MIDI file, modified MIDI file 420 is more susceptible to real time adjustments by control processors of administrator 414. FIG. 8 illustrates an embodiment of administrator 414 including three control processors. The three control processors include a schedule control processor 800, a manual control processor 802, and a software control processor 804. The relative effects these processors have on modified MIDI file 420 is controllable by the user by the adjustment of weighting factors (not shown). The weighting factors are used to generate a weighted average of the effects of the control processors. These control processors (or the weighted average of the control processors) alter the parameters in the modified MIDI file 420 to generate altered MIDI file 422.

Schedule control processor 800 is set prior to the performance of a MIDI program to change parameters of an instrument or a group at a preset point during the playing of the MIDI files. Furthermore, schedule control processor 800 can change channel groupings (described in more detail below), channel voice message groupings (described in more detail below), and other parameters as determined by a programmer at preset points during playback. The preset conditions are static and can be set to occur at any time during the playback of the musical score. A user interfaces with schedule control processor 800 by means of either of two interfaces for manual operation for manual control processor 802, described below.

Manual control processor 802 provides two interfaces for manual operation. Each is sufficient for enabling manual operation. One interface is a graphic control interface unit which, in a preferred embodiment, is equivalent to a graphic interface screen displayed on a host personal computer (not shown). The other interface is a control deck (not shown) which, in a preferred embodiment, is attached to a serial port of MIDI controller 406 (not shown). Normally, manual control processor 802 functions as a conventional mixing board (not shown) and allows the musician, during playback, to adjust playback speed, overall loudness and pitch, etc. Using these interfaces, the parameters and parameter groupings of all of the MIDI file channels and channel groupings can be adjusted. The user adjusts the MIDI file parameters using fixed control buttons. These control buttons are arranged into groups such that each group of control buttons consists of five control buttons that may be continually adjusted and three switches that may be set as one-touch or on/off. Additionally, the graphic control interface unit has an alpha-numeric interface to allow the user to enter alpha-numeric data, for example, a channel group identification name. Any alpha-numeric data is entered by using the alpha-numeric interface to select the data and depressing an OK button on the graphic control interface.

Software control processor 804 can be a fuzzy logic control processor. The fuzzy logic enhances the ability of software control processor 804. The fuzzy logic of software control processor 804 is described more fully in copending application of Alvin Wen-Yu Su et al. for METHOD AND APPARATUS FOR INTERACTIVE MUSIC ACCOMPANIMENT, Ser. No. 08/882,235, filed the same date as the present application, which disclosure is incorporated herein by reference. Additionally, software control processor 804 is capable of altering various MIDI file inputs so that parameters, such as, for example, a beat of each MIDI signal, match. This type of control is especially useful for simultaneously playing with both live and recorded signals.

More particularly, software control processor 804 is a fuzzy control process that processes two types of data sources. One type of data source is a converted analog data source, such as, for example, a human voice or analog musical instruments into the necessary control signals. The other type of data source is a digital source, such as, for example, a stored MIDI file or MIDI compatible digital instrument.

Prior to processing, the analog data source human live performance attributes (e.g., Largo or Presto, Forte or Piano, etc.) are converted into MIDI control parameters by the extraction of the source parameters. These parameters are, for example, pitch, volume, speed, beat, etc. Once converted into MIDI control parameters, software control processor 804 functions to match user selected parameters, such as the beat, of the digital data source to the original analog data source. The fuzzy control process includes parameter adjustment models for music measures and phrases in order to facilitate the operation of software control processor 804.

In order to facilitate control processors 800, 802, and 804, MIDI controller 406 provides for channel grouping, channel voice message grouping, and compound grouping. Compound grouping is a combination of channel grouping and channel voice message grouping. MIDI controller 406 uses commands from control processors 800, 802, and 804 to control the various groups instead of requiring control of individual channels and channel voice messages.

An industry standard MIDI recording system has 16 channels. Each channel typically produces the sound of only one instrument at a time. Tone generator 408, if provided as a conventional tone generator, is capable of producing the music of up to 16 instruments at a time. A channel voice message is a signal that changes the way a note or individual channel sounds. In other words it may be a message to sustain notes, add a reverberation effect, etc.

Figure 9:
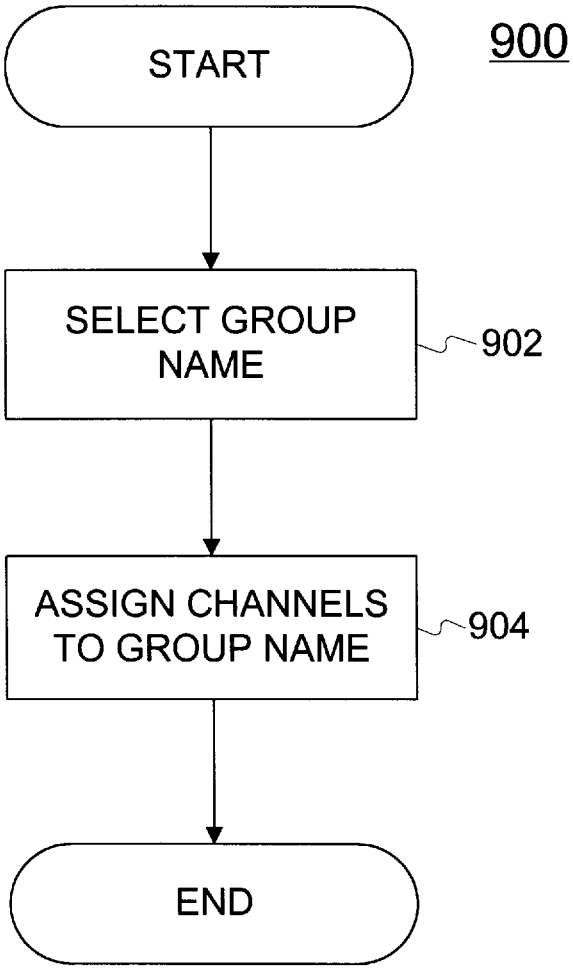
FIG. 9 is a flow chart illustrative of a method for grouping channels in accordance with the present invention.

Channel grouping is used to adjust a parameter of a particular group of instruments. For example, it may be desired to adjust all of the woodwind instrument channels at the same time. FIG. 9 is a flow chart 900 illustrating the functions performed by MIDI controller 406 in order to group channels. First, a group name is selected (step 902). Next, the channels to be grouped together are assigned to that group name (step 904). In particular, MIDI controller 406 stores channel group information as a series of bytes. Each logic "1" bit in the series of bytes represents a particular channel assigned to that channel group. Thus, if four instrument channels were assigned to the group, then the file would consist of a series of bytes with all bits, but the 4 bits associated with the assigned channels, at a logic "0". Each logic "1" is representative of an associated individual channel. Thus, when a grouped channel is selected for control, all of the assigned individual channels receive the command.

More particularly, grouping channels together allows the user to adjust a particular parameter for each instrument of the group by merely indicating the name of the channel group and the change, rather than indicating the change for each channel number individually. Channel groups are set using the graphic control interface unit to input the channel group names, then selecting the desired channels, and finally pressing the OK button (as outlined in flow chart 900 of FIG. 9). For example, if recording system 400 is configured to process two MIDI files, for example, MIDI source 1 and MIDI source 2, substantially simultaneously, the format for each channel group information file is channel_group_name: byte1byte2byte3byte4 of which channel group name is the name of the channel group that is entered as a character string. The four data bytes 1–4 denote particular channels assigned to that group, notice that bytes 1 and 2 control the channels of one MIDI file and bytes 3 and 4 the channels of the second MIDI file. The group name and channel designation are separated by the closing symbol ".". The respective bits of byte 1 through byte 4 are defined as follows:

- byte 1: MIDI source 1 channel 15 to channel 8, where the most significant bit ("MSB") is channel 15;
- byte 2: MIDI source 1 channel 7 to channel 0, where the MSB is channel 7;
- byte 3: MIDI source 2 channel 15 to channel 8, where the MSB is channel 15; and
- byte 4: MIDI source 2 channel 7 to channel 0, where the MSB is channel 7.

The channel group information file contains two bytes for each MIDI file that recording system 400 is configured to process. For every MIDI file, each bit of the two bytes is associated with a particular channel of that MIDI file. Thus, if a particular channel is selected, then the corresponding bit is set at 1, otherwise it is set at 0. For example, if one wished to define the woodwind instrument group with the channel group name WINDS, consisting of the following channels: MIDI source channels 9, 8, 5, 4 for the processing of one MIDI file and MIDI source channels 10, 9, 6, and 5 for the processing of a second MIDI file, then the data format would be WINDS:03300660.

MIDI controller 406 also groups channel voice messages in a manner similar to channel grouping. However, instead of grouping channels together, channel voice messages are grouped together. Thus, when a channel voice message group is given to a channel, the channel receives the several channel voice messages substantially simultaneously. The channel voice message grouping can be entered into MIDI controller 406 using the graphic control interface unit. Each channel voice message group is a series of 2 byte words. The first byte is the selected channel voice message, such as note off, note on, polyphonic key pressure, control change, program change, channel pressure, and pitch wheel change. The second byte is generally a specific note number to be effected by the channel voice message, although other messages are allowable. The end of the channel voice message grouping requires identification and, in the preferred embodiment, the end of the group is designated by a control byte of 0.

More particularly, channel voice message grouping is capable of grouping certain changes affecting the MIDI performance together. This facilitates control by means of the control deck and the graphic control interface unit. Channel voice messages are grouped in the same manner as channel groups, i.e., entering the channel voice message group name, then selecting or entering each channel voice message, and then pressing an add key of the graphic control interface unit, one by one, followed by the depression of the OK button when the setting is complete, a process which is similar to the one illustrated by flow chart 900 of FIG. 9. Once set, the channel voice message grouping has the following format: channel_group_name:SBDBCBSBDBCBSBDBCB . . . . In this format, SB is byte 1 of the selected channel voice message, with numerical values and categories such as 80=Note off, 90=Note on, A0=polyphonic key pressure, B0=control change, C0=program change, D0=channel pressure, and E0=pitch wheel change. DB is byte 2 of the selected channel voice message, the numerical value of which is generally between 00 and 7F, which indicates individual notes. However, a numerical value of 80 for note on, note off or polyphonic key pressure denotes that it affects all note numbers. The numerical value for control change is 00-7F, and is used to select the controller. For channel pressure and pitch wheel changes, the numerical value is fixed at the sole numerical value of 0. CB is the internal control byte. This byte is used to indicate the end of the channel voice message group when CB is "0", otherwise there are additional SBs and DBs in the group.

Channel voice message grouping enhances musical performance because, for example, musical expression and volume are frequently interrelated. The functionality of channel voice message grouping makes the playback more effectively controllable. For example, the interrelation among the note on, note off, breath controller, and expression controller functions can be set jointly; then, using different conversion programs, described below, these system parameters can be modified simultaneously with the adjustment of one control button.

As identified above, channels and channel voice messages may be grouped together in a compound group. This allows for simultaneous setting of channels or channel groups with channel voice messages or channel voice message groups. The manner in which they are set is as follows: Using the graphic control interface unit, a compound group name is entered, and then a channel or a channel group is selected. Next, a channel voice message or channel voice message group is selected. When this setting is complete, the OK button is pressed, a process which is similar to the one illustrated by flow chart 900 of FIG. 9. The file format for compound groups is: compound_group_name:CH_Name:CH_V_Name:TAG[:CH_NAME:CH_V_NAME:TAG] of which CH_NAME is the name of the channel group or the individual channel. Individual channel names are defined as SxCy, where the parameter x equals the number of MIDI files being processed by the MIDI controller 406. In the preferred embodiment recording system 400 is configured to process two MIDI files and, therefore, x is equal to 1 or 2. The parameter y is equal to a value in the range 0–15, which is equivalent to the number of MIDI channels. Thus, Sx represents MIDI file source and Cy represents the channel from 0–15. CH_V_NAME is the channel voice message group name and has the format SBDB, wherein SBDB has the same meaning as described in channel voice message grouping, above. TAG equals 0 or 1. TAG 0 denotes that there is not another string of grouping, whereas TAG 1 denotes that there is another set of CH_NAME:CH_V_NAME:TAG data.

Control processors 800, 802, and 804 alter modified MIDI file 420 to produce altered MIDI file 422 by using either a revision type or an increase type control process. The increase type control process is one in which, for example, a control signal from one of processors 800, 802, or 804 indicates a change from note 1 to note 2 to be a sliding change, i.e., a gradual note change continuously from note 1 to note 2. Altered MIDI file 422 would, therefore, include the additional notes, which are added by administrator 414, necessary to produce the continuous change. In contrast, in accordance with the revision type control process, a control signal would indicate an instantaneous note change from note 1 to note 2. In this case, altered MIDI file 422 would include the change of note and not include additional notes between note 1 and note 2. Thus, the revision type control process does not increase the MIDI file size, but merely revises the MIDI events stored in the file. The increase type control process, however, produces additional MVEs and increases the MIDI file size.

The increase type of control process can be effected in accordance with several different data conversion programs, such as linear conversion, log conversion, exponential conversion, and nonlinear mapping.

The linear conversion program effects a linear conversion of the values transmitted by the control deck or the graphic control interface unit within the selected upper and lower bounds to derive an output value. Linear conversion is set by selecting the linear conversion function on the graphic control interface unit as the conversion method and then manually selecting an upper bound and a lower bound. Conversion is then performed using the external input value conversion formula:

$$\text{new_value}=\text{Lower_bound}+(\text{Upper_bound}-\text{Lower_bound})\cdot V/255, \quad \text{(Eq. 1)}$$

where Lower_bound and Upper_bound are the preset scope of output values, and V is the value transmitted by the control deck or the graphic control interface unit.

The log conversion and exponential conversion programs are similar to the linear conversion program except that they use a Log and an Exponential function, respectively. Log conversion is performed by:

$$\text{new_value}=\text{Lower_bound}+(\text{Upper_bound}-\text{Lower_bound})\cdot(\log V/\log 255) \quad \text{(Eq. 2)}$$

Exponential conversion is performed by:

$$new_value = Lower_bound + (Upper_bound - Lower_bound) \cdot (exp\ V / exp\ 255) \quad \text{(Eq. 3)}$$

In equations (2) and (3) Lower_bound and Upper_bound are the preset scope of output values, and V is the value transmitted by the control deck or the graphic control interface unit.

The nonlinear mapping conversion method performs a one-to-one irregular conversion of the output value and V. This method is entered by selecting the nonlinear mapping method on the control deck or the graphic control interface unit and then sequentially entering the mapping values 0–255 which correspond to the original values. This conversion method is the most flexible, but requires the input of each mapping value.

The pre-processing performed on the MIDI file 418 and the control processing performed on the modified MIDI file 420 produce altered MIDI file 422. Because the pre-processing and control processing may have increased the size of the MIDI file beyond the transmission capacity of the interface system, data optimizer 416 optimizes altered MIDI file 422 to produce optimized MIDI file 424, which is suitable for broadcast. Different variations of optimization methodologies are available. However, satisfactory optimization methods include running status optimization and process flow for broadcast.

Figure 10:
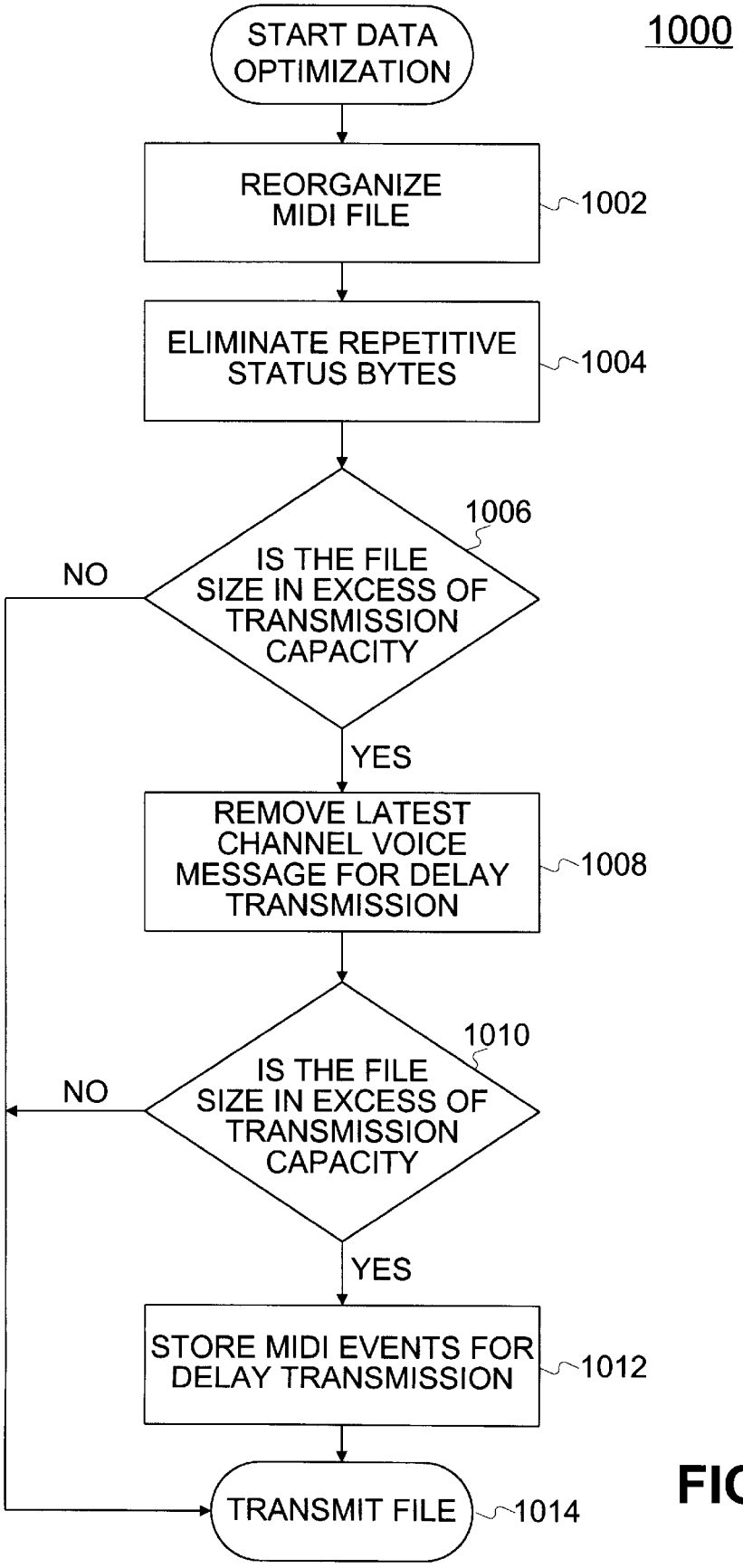
FIG. 10 is a flow chart illustrative of a data optimization method in accordance with the present invention.

One example of an optimization procedure is illustrated in FIG. 10. FIG. 10 is a flow chart 1000 of a running status optimization method. First, data optimizer 416 reorganizes altered MIDI file 422 so that MVEs, which consist of status bytes and data bytes, containing the same status byte are sequential (step 1002). Next, data optimizer 416 deletes all but one of the identical status bytes (step 1004). If the file for transmission has a size not in excess of transmission capacity (step 1006), then the file is transmitted (step 1014). However, if the file for transmission is still in excess of the transmission capacity (step 1008), then the latest channel voice message change is removed from the file and stored for delayed transmission (step 1008). If the file for transmission is still in excess of the transmission capacity (step 1010), some of the MIDI events are stored for delayed transmission (step 1012). In the event that subsequent MIDI events are stored for delayed transmission, and the subsequent MIDI event has the same status byte as another MIDI event currently stored for delayed transmission, then the subsequent MIDI event overwrites the MIDI event currently stored.

Figure 11:
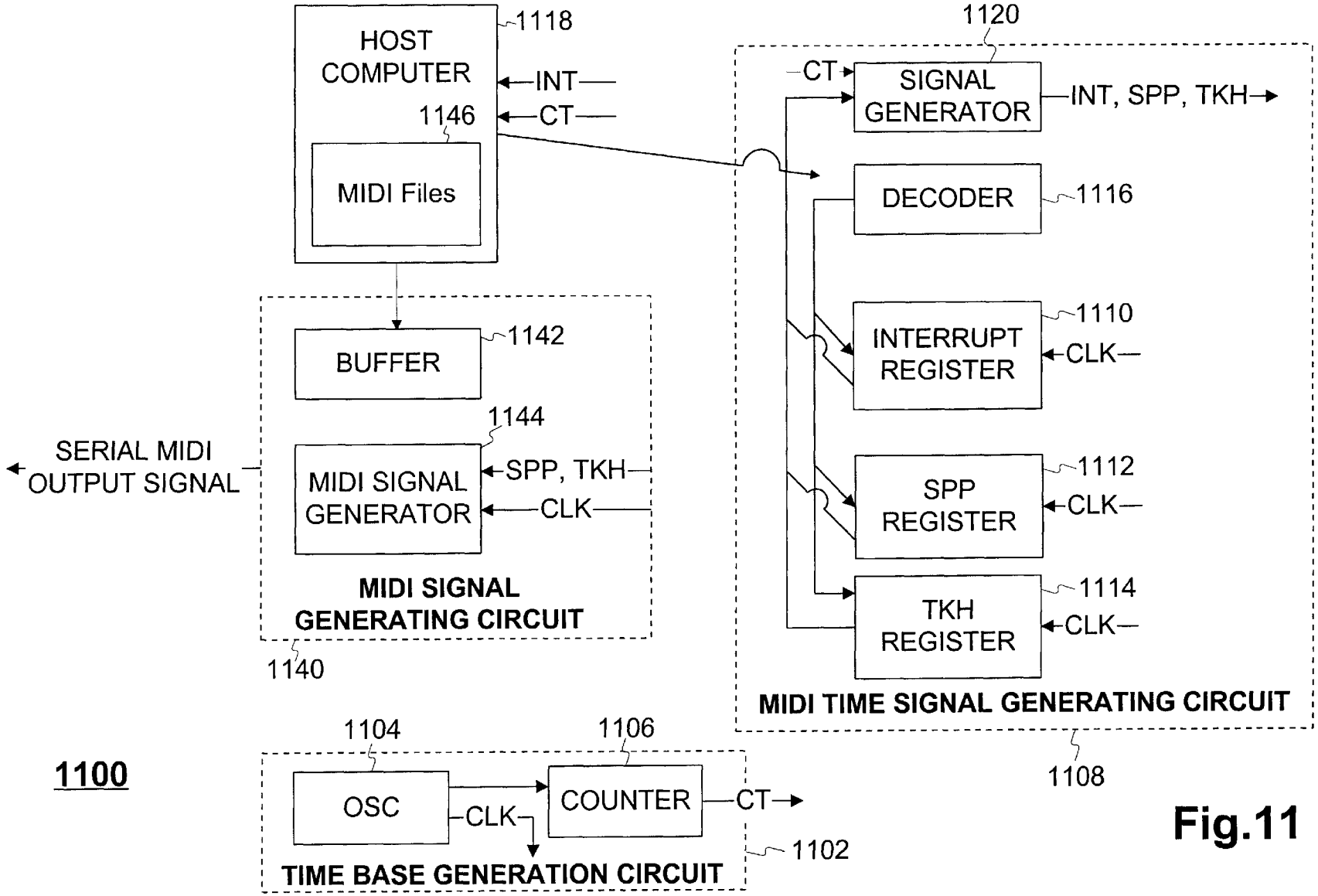
FIG. 11 is a diagrammatic representation of a MIDI output interface circuit in accordance with the present invention.

To have real time control over the modified MIDI file, MIDI controller 406 has a MIDI output interface circuit 1100. FIG. 11 illustrates MIDI output interface circuit 1100. Circuit 1100 includes a time-base generation circuit 1102 that comprises an oscillator source circuit 1104, such as a quartz crystal oscillator, and a counter 1106. Circuit 1104 can be provided as a clock circuit driven by a 2 MHZ oscillator to provide a clock signal CLK. Counter 1106, driven by oscillator source circuit 1104, provides a count signal CT. For example, counter 1106 can be provided with a 20-bit length, which returns to "0" and resets every 300 milliseconds. Circuit 1100 also includes a MIDI time signal generating circuit 1108. Circuit 1108 includes an interrupt register 1110 for holding an 8-bit value representative of the time until the next system interrupt, a time clock signal SPP register 1112 for storing the time when the MIDI signal source should generate a synchronizing signal, and a tick high time TKH register 1114 for storing the time when the MIDI signal source should transmit the MIDI signals. Circuit 1108 also includes a decoder 1116 which receives commands from a microprocessor in an associated host computer 1118 and writes data from the microprocessor into the registers 1110, 1112, and 1114. Circuit 1108 further includes a signal generator circuit 1120 coupled to receive the current value held in registers 1110, 1112, and 1114 and the count signal CT, which is the current value of counter 1106. Signal generator circuit 1120 includes a comparison circuit that operates to compare the value held in each of registers 1110, 1112, and 1114 with the count signal CT. The comparison circuit triggers signal generator 1120 to generate a signal INT when the value in register 1110 matches the counter signal CT, a signal SPP when the value of register 1112 matches the count signal CT, and a signal TKH when the value of register 1114 matches the current signal.

Circuit 1100 also includes a MIDI signal generating circuit 1140 that includes a buffer memory 1142 and a MIDI signal generator 1144. Buffer 1142 is coupled to receive optimized MIDI files from a memory 1146 in host computer 1118. MIDI signal generating circuit 1140 performs the function of merging optimized MIDI files and the synchronizing signal from MIDI time signal generating circuit 1108 and transmitting the merged data as a serial MIDI output signal.

In operation, the microprocessor in host computer 1118 causes optimized MIDI files stored in memory 1146 to be transferred to buffer 1142. When the TKH signal is generated by time signal generating circuit 1108 and received by MIDI signal generating circuit 1140, MIDI signal generator 1144 commences to retrieve MIDI signals from buffer 1142 and output them in serial form. In response to generation of the SPP signal, MIDI signal generator 1144 inserts 1 byte F8H into the serial MIDI signal. This byte is used to synchronize the MIDI sound module receiving the serial MIDI signal.

The microprocessor in host computer 1118 periodically stores a value in interrupt register 1110 that represents the next time to interrupt host computer 1118. Subsequently, when signal generator 1120 generates the INT signal when the count signal CT equals the value in interrupt register 1110, the microprocessor host computer 1118 responds by transferring additional MIDI data to buffer 1142. This ensures that MIDI signal generator 1144 continuously generates serial MIDI signals.

In summary, a recording system constructed in accordance with the present invention enhances the ability of a user to control MIDI file parameters. The enhanced control is achieved primarily by a pre-processor that modifies a MIDI file that may be stored in any of three formats into a single modified format. As part of this pre-processing, information stored in the MIDI file that is not necessary for the playback function is eliminated. The actual enhancement is achieved because the modified MIDI file, with a standard format and less extraneous data, is more susceptible to real time parameter adjustment by the schedule control processor, the manual control processor, and the software control processor, which are managed by the control process administrator, than a non-modified MIDI file.

The real time parameter adjustments include two types. One type may increase the data in the MIDI file and other real time parameter adjustments may revise the existing data in the MIDI file. In order to ensure that increasing the data in the MIDI file does not overload the recording system transmission capacity, the recording system is equipped with a data optimizer.

Each of the control processors have the capability to adjust MIDI file parameters on a channel by channel basis; however, in accordance with a further aspect of the present invention, recording systems further enhance real time control by providing a process by which a user selects channels to be grouped, channel voice messages to be grouped, or any combination thereof. The grouping enhances real time control because changing a single group parameter affects several channels or channel voice messages.

Additionally, recording systems constructed in accordance with the present invention are capable of processing MIDI files substantially continuously. In order to continuously process MIDI files, the recording system is equipped with an output interface circuit. The output interface circuit generates a timing sequence that coordinates transmission of MIDI files.

A recording system constructed in accordance with the present invention reduces both the amount of data the recording system processes, through pre-processing, and the number of channel and channel voice message commands, through channel grouping, channel voice message grouping, and compound grouping. By reducing the data and number of commands, the recording system reduces the processing time and processing resources required during playback of MIDI files.

It will be apparent to those skill in the art that various modifications and variations can be made in the method of the present invention and in construction of the preferred embodiments without departing from the scope or spirit of the invention. Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A method for processing musical instrument digital interface (MIDI) files, comprising the steps, performed by a processor, of:

receiving a MIDI file having a plurality of events that represent musical information;

extracting from the MIDI file timing information;

storing the extracted timing information in a modified file;

extracting a next event from the MIDI file;

determining whether the next event is necessary for musical production;

storing the next event in the modified file if the next event is necessary for musical production;

repeating the extracting and next event storing steps if a further next event exists in the MIDI file; and outputting the modified file.

2. A method for processing musical instrument digital interface (MIDI) files, comprising the steps, performed by a processor, of:

(a) receiving a MIDI file having a plurality of chunk data, each chunk data including a plurality of events;

(b) extracting a first chunk data from the MIDI file;

(c) extracting from the first chunk data timing information;

(d) storing the extracted timing information in a modified file;

(e) extracting a next event from the first chunk data;

(f) determining whether the next event is necessary for musical production and storing the next event in the modified file if the next event is necessary for musical production;

(g) repeating steps (e)–(f) if a further next event exists in the first chunk data;

(h) transferring the timing information from the modified file to a temporary file;

(i) extracting a next chunk data from the MIDI file;

(j) extracting a first next event from the modified file;

(k) generating a first next event time accumulation signal;

(l) extracting a second next event from the next chunk data;

(m) generating a second next event time accumulation signal;

(n) storing the first next event in the temporary file and the second next event in the next chunk data if the first next event time accumulation signal is no greater than the second next event time accumulation signal;

(o) storing the second next event in the temporary file and the first next event in the modified file if the first next event time accumulation signal is greater than the second next event time accumulation signal;

(p) repeating steps (j)–(o) until all of the modified events and chunk data events have been stored in the temporary file;

(q) storing the temporary file as the modified file; and (r) repeating steps (i)–(q) until all of the chunk data have been stored into the modified file.

3. The method of claim 2 wherein each of the steps (k) and (m) comprise the steps of:

selecting a set tempo and a number of clock ticks per MIDI quarter note value; and generating an accumulated time signal based on the set tempo and the number of clock ticks per MIDI quarter note value.

4. An apparatus for processing musical instrument digital interface (MIDI) files, comprising:

a memory for storing MIDI files in one of formats 0, 1, and 2; and a MIDI controller including a pre-processor for converting the MIDI files into a predetermined format, a control process administrator for selectively changing MIDI parameters of each converted MIDI file, and a data optimizer to ensure each converted MIDI file processed by the control process administrator has a size within a predetermined transmission capacity.

5. The apparatus of claim 4 wherein the MIDI controller includes a timer including a counter;

a MIDI time signal generating circuit including an interrupt storage register, a tick high time storage register, and a SSP storage register;

a MIDI signal generating circuit for receiving a MIDI file; and means for comparing values in the interrupt storage register, the tick high time register, and the SSP storage register with a current value of the counter; and wherein the MIDI time signal generating circuit includes means, responsive to the comparing means, for generating an output MIDI file.

6. A musical instrument digital interface (MIDI) controller comprising:

means for pre-processing a standard MIDI file stored in a memory to generate a modified MIDI file wherein the processing means comprises:

means for extracting the standard MIDI file from the memory;

means for determining a format of the standard MIDI file; and means for converting the standard MIDI file to the modified MIDI file in accordance with the determined format, wherein the means for converting the standard MIDI file comprises:

means for storing timing information of the standard MIDI file in a modified MIDI file;

means for iteratively extracting a plurality of MIDI events from the standard MIDI file;

means for determining, for each extracted MIDI event, whether the extracted MIDI event is required for playback; and means for storing each extracted MIDI event determined to be required for playback in the modified MIDI file;

means for controlling at least one parameter of the modified MIDI file; and means for optimizing the modified MIDI file for transmission.

7. The MIDI controller of claim 6 wherein the controlling means includes a schedule controller, a manual controller, and a software controller.

8. The MIDI controller of claim 6 wherein the controlling means includes means for discretely revising at least one parameter of the modified MIDI file.

9. The MIDI controller of claim 6 wherein the controlling means includes means for changing at least one parameter of the modified MIDI file from a first value to a second value in accordance with a predetermined function defining additional values between the first and second values.

10. A MIDI controller of claim 6 wherein the controlling means includes means for discretely revising at least one parameter of the modified MIDI file and means for changing at least one parameter of the modified MIDI file from a first value to a second value in accordance with a predetermined function defining additional values between the first and second values.

11. The MIDI controller of claim 9 wherein the predetermined function is a linear conversion function.

12. The MIDI controller of claim 9 wherein the predetermined function is a log conversion function.

13. The MIDI controller of claim 9 wherein the predetermined function is an exponential conversion function.

14. The MIDI controller of claim 9 wherein the predetermined function is a non-linear mapping function.

15. The MIDI controller of claim 9 wherein the predetermined function is at least one of a linear conversion function, a log conversion function, an exponential conversion function, and a non-linear mapping function.

16. A computer program product comprising:

a computer usable medium having computer readable code embodied therein for processing data and a musical instrument digital interface (MIDI) controller, the computer usable medium comprising:

a receiving module configured to receive a MIDI file to be processed by the MIDI controller;

an event module configured to process events in the MIDI file and determine whether each event is necessary for musical production;

a preprocessing module configured to convert the MIDI file into a predetermined format, said predetermined format including only events necessary for musical production;

a control process module configured to selectively change MIDI parameters of the converted MIDI file; and a data optimizing module configured to optimize the converted MIDI file processed by the control process module into a size within a predetermined transmission capacity.

* * * * *